US012791269B2

(12) United States Patent
Bishop

(10) Patent No.: US 12,791,269 B2
(45) Date of Patent: Nov. 10, 2026

(54) FIREARM RECEIVER WITH INTEGRATED MOUNTS

(71) Applicant: Tomm-Cat 22, LLC, Buckner, MO (US)

(72) Inventor: Steven N. Bishop, Buckner, MO (US)

(73) Assignee: Tomm-Cat 22, LLC, Buckner, MO (US)

( * ) Notice: Subject to any disclaimer, the term of this patent is extended or adjusted under 35 U.S.C. 154(b) by 0 days.

(21) Appl. No.: 19/259,031

(22) Filed: Jul. 3, 2025

(65) Prior Publication Data

US 2026/0016245 A1 Jan. 15, 2026

Related U.S. Application Data

(60) Provisional application No. 63/671,612, filed on Jul. 15, 2024.

(51) Int. Cl.
*F41A 3/66* (2006.01)
*F41A 19/10* (2006.01)

(52) U.S. Cl.
CPC ..... *F41A 3/66* (2013.01); *F41A 19/10* (2013.01)

(58) Field of Classification Search
CPC .. F41A 3/66; F41A 19/10; F41A 11/00; F41A 11/02; F41A 21/48; F41A 21/487
See application file for complete search history.

(56) References Cited

U.S. PATENT DOCUMENTS 3,183,617 A * 5/1965 Ruger ..... F41A 21/484 42/25
6,637,142 B1 * 10/2003 Reynolds ..... F41A 21/485 42/1.06
7,131,228 B2 * 11/2006 Hochstrate ..... F41C 23/16 42/75.01
7,302,881 B1 * 12/2007 Tertin ..... F41A 21/484 42/77
7,735,409 B1 * 6/2010 Tertin ..... F41A 21/10 42/69.02
7,810,271 B2 * 10/2010 Patel ..... F41A 3/66 42/75.03
8,713,838 B2 * 5/2014 Ubl ..... F41A 21/48 42/71.01

(Continued)

OTHER PUBLICATIONS

Auto-Ordnance, Thompson M1 Submachine Gun, at least as early as May 14, 2024, 1 page, United States of America.

(Continued)

*Primary Examiner* — Joshua E Freeman
(74) *Attorney, Agent, or Firm* — Coughlin Law Office LLC; Stuart M. Aller; Daniel J. Coughlin

(57) ABSTRACT

The firearm has a receiver with a foregrip mount portion and a buttstock mount portion. The foregrip mount portion is structured to attach a barrel-foregrip retainer to secure a barrel and a foregrip. The buttstock mount portion is structured to accommodate a buttstock. The receiver provides a stable platform for attaching a trigger assembly. An upper portion of the trigger assembly is received into a trigger well of a grip frame. A retaining member extends upwardly from the grip frame. The retaining member is structured to retain a pin disposed through the receiver. The receiver with integrated mounts offers a firearm configuration that suits a user, making it a versatile and functional firearm.

14 Claims, 4 Drawing Sheets

(56) References Cited

U.S. PATENT DOCUMENTS

| | | | | |
|---|---|---|---|---|
| 8,769,854 | B1 * | 7/2014 | Battaglia | F41A 11/02 42/75.01 |
| 9,091,505 | B1 * | 7/2015 | Battaglia | F41C 23/20 |
| 9,322,611 | B1 * | 4/2016 | Barfoot | F41A 21/48 |
| 9,429,387 | B1 * | 8/2016 | Barfoot | F41C 23/20 |
| 9,733,031 | B1 * | 8/2017 | Sylvester | F41A 3/66 |
| 9,766,029 | B2 * | 9/2017 | Dextraze | F41A 29/00 |
| 9,777,981 | B1 | 10/2017 | Bower | |
| 10,012,460 | B1 * | 7/2018 | Vankeuren, III | F41A 3/66 |
| 10,345,076 | B2 * | 7/2019 | Fiester | F41C 23/16 |
| D879,234 | S * | 3/2020 | Barfoot | D22/108 |
| 11,226,170 | B2 * | 1/2022 | Lynch | F41A 11/04 |
| 2005/0188584 | A1 | 9/2005 | Orth | |
| 2010/0170130 | A1 * | 7/2010 | Tertin | F41A 11/02 29/401.1 |
| 2016/0273875 | A1 | 9/2016 | Cottle | |
| 2017/0059271 | A1 | 3/2017 | Bowen | |
| 2018/0112939 | A1 * | 4/2018 | Wheatley | F41A 3/72 |
| 2018/0195822 | A1 * | 7/2018 | Jonsson | F41A 3/66 |
| 2020/0333097 | A1 * | 10/2020 | Hendricks | F41A 21/487 |
| 2022/0364810 | A1 | 11/2022 | Stenzel | |

OTHER PUBLICATIONS

Auto-Ordnance, Model 10/22 Autoloading Rifle, at least as early as May 14, 2024, 1 page, United States of America.

HKP, MP5A2/A3 Submachine Gun Caliber 9mm X 19, Heckler & Koch, 3 pages, HK, United States of America.

Mike Johnson, TFB, Rimfire Tommy Gun Designed by TFB Reader Mike Johnson, Johnson Semi-Automatic Carbine, Apr. 21, 2021, 8 pages, United States of America.

Eisel Armory, YouTube, Auto Ordnance Thompson Model 1927A3 Semi Auto, .22LR Carbine-Excellent, at least as early as May 14, 2024, 1 page, youtube.com/watch?v=pjbLOus2XSg, United States of America.

Auto-Ordnance, Thompson Auto-Ordnance, Overview: Thompson SBR, at least as early as May 14, 2024, 5 pages, United States of America.

Forgotten Weapons, YouTube, Voere SAM-180—Semiautomatic American 180 SMG Made in Austria?, at least as early as May 14, 2024, 2 pages, YouTube, United States of America.

* cited by examiner

FIREARM RECEIVER WITH INTEGRATED MOUNTS

CROSS REFERENCES

This US Non-Provisional application claims the benefit of U.S. Provisional Application No. 63/671,612, entitled "Firearm Receiver with Integrated Mounts", and filed on 15 Jul. 2024, which is incorporated herein by reference in its entirety.

REFERENCE TO RESEARCH

Not Applicable.

REFERENCE TO CDS

Not Applicable.

FIELD OF THE INVENTION

The present disclosure relates to a firearm having a receiver with integrated mounts for the buttstock, foregrip, and trigger assembly.

BACKGROUND

The Ruger model 10/22 autoloading rifle is a semi-automatic rifle chambered for the .22 long rifle rimfire cartridge. The Ruger 10/22 typically utilizes a 10-round box rotary magazine. The standard version of the Ruger 10/22 has been one of the most successful rimfire rifle designs produced in history.

SUMMARY

In some aspects, the firearm has: (a) a receiver with: (i) a foregrip mount portion; (ii) a buttstock mount portion with a retention rail disposed on the bottom side of the receiver; (b) a grip frame mounted to the receiver, the grip frame with: (i) a rearward portion; and (c) a buttstock including: (i) a keyed rail groove structured to receive the retention rail.

In some aspects, the buttstock further has: (a) a retention pin disposed within the keyed rail groove that is structured to be selectively partially inserted into the retention rail to retain the buttstock upon the receiver; and (b) a button mounted on the buttstock that is structured to disengage the retention pin from the retention rail.

In some aspects, the firearm further has: (a) a barrel mounted to the receiver, the barrel with: (i) a retaining slot disposed within a lower portion of the barrel; (b) a barrel-foregrip retainer secured to the foregrip mount portion, the barrel-foregrip retainer with: (i) a block having an upper portion that is structured to engage the retaining slot of the barrel and secure the barrel to the receiver.

In some aspects, the barrel-foregrip retainer further has: (a) an elongated foregrip mount extending parallel with the barrel, where the block extends perpendicular to the elongated foregrip mount.

In some aspects, the firearm further has: (a) a forward portion of the grip frame with a magazine well that is structured to removably receive a magazine.

In some aspects, the rearward portion of the grip frame has a trigger assembly well that is structured to house an upper portion of a trigger assembly.

In some aspects, the trigger assembly received within the trigger assembly well is mounted to the receiver.

In some aspects, the firearm further has: (a) a trigger assembly; and (b) a first receiver cross pin disposed through the receiver and the trigger assembly to mount the trigger assembly to the receiver.

In some aspects, the firearm has: (a) a receiver with: (i) a foregrip mount portion; (ii) a buttstock mount portion; (b) a barrel mounted to the receiver, the barrel with: (i) a retaining slot disposed within a lower portion of the barrel; (c) a barrel-foregrip retainer secured to the foregrip mount portion, the barrel-foregrip retainer with: (i) a block having an upper portion that is structured to engage the retaining slot of the barrel and secure the barrel to the receiver.

In some aspects, the barrel-foregrip retainer further has: (a) an elongated foregrip mount extending parallel with the barrel, where the block extends perpendicular to the elongated foregrip mount.

In some aspects, the firearm further has: (a) a trigger assembly; and (b) a first receiver cross pin disposed through the receiver and the trigger assembly to mount the trigger assembly to the receiver.

In some aspects, the firearm further has: (a) a grip frame mounted to the receiver; and (b) a cross pin retaining member that is elongated and extends upwardly from the grip frame adjacent to the receiver and is structured to retain a first receiver cross pin.

In some aspects, the grip frame has: (a) a bolt stop retaining member that extends upwardly from the cross pin retaining member adjacent to the receiver and is structured to retain a bolt stop pin disposed through the receiver.

In some aspects, the firearm further has: (a) a retention rail disposed on a buttstock mount portion on the bottom side of the receiver; and (b) a buttstock with: (i) a keyed rail groove structured to receive the retention rail.

In some aspects, the firearm further has: (a) a trigger assembly; (b) a grip frame mounted to the receiver, the grip frame with: (i) a trigger assembly well that is disposed in a rearward portion of the grip frame and is structured to house an upper portion of the trigger assembly; and (c) wherein the trigger assembly is received within the trigger assembly well and mounted to the receiver.

In some aspects, the grip frame further has: (a) a magazine well that is disposed in a forward portion of the grip frame and is structured to removably receive a magazine.

In some aspects, the firearm has: (a) a receiver; (b) a trigger assembly; (c) a grip frame mounted to the receiver, the grip frame with: (i) a trigger assembly well that is disposed in a rearward portion of the grip frame and is structured to house an upper portion of the trigger assembly; and (d) wherein the trigger assembly is received within the trigger assembly well and mounted to the receiver.

In some aspects, the grip frame further has: (a) a magazine well that is disposed in a forward portion of the grip frame and is structured to removably receive a magazine.

In some aspects, the firearm further has: (a) a barrel mounted to the receiver, the barrel with: (i) a retaining slot disposed within a lower portion of the barrel; and (b) a barrel-foregrip retainer secured to a foregrip mount portion of the receiver, the barrel-foregrip retainer with: (i) a block having an upper portion structured to engage the retaining slot of the barrel and secure the barrel to the receiver.

In some aspects, the barrel-foregrip retainer further has: (a) an elongated foregrip mount extending parallel with the barrel, wherein the block extends perpendicular to the elongated foregrip mount.

In some aspects, the firearm further has: (a) a retention rail disposed on a buttstock mount portion on the bottom side of the receiver; (b) a buttstock including: (i) a keyed rail groove structured to receive the retention rail.

The above advantages and features are of representative embodiments only, and are presented only to assist in understanding the invention. It should be understood that they are not to be considered limitations on the invention as defined by the claims. Additional features and advantages of embodiments of the invention will become apparent in the following description, from the drawings, and from the claims.

BRIEF DESCRIPTION OF DRAWINGS

Aspects are illustrated by way of example, and not by way of limitation, in the accompanying drawings, wherein.

DETAILED DESCRIPTION

The firearm has frame mounts that provide a secure platform for integration of firearm components. A receiver of the firearm has a foregrip mount portion and a buttstock mount portion. A barrel-foregrip retainer securely mounts a barrel to the receiver at the foregrip mount portion. A block of the barrel-foregrip retainer engages with a retaining slot disposed within a lower portion of the barrel. The block extends perpendicularly to an elongated foregrip mount of the barrel-foregrip retainer. The barrel-foregrip retainer extends parallel with the barrel when mounted. A buttstock securely mounts with the upper receiver at the buttstock mount portion. A keyed rail groove in the buttstock receives a retention rail disposed on the bottom side of the receiver. The keyed rail groove is structured to receive the retention rail to retain the buttstock upon the receiver. A grip frame mounted to the receiver has a trigger assembly well that is disposed in a rearward portion and a magazine well that is disposed in a forward portion. The trigger assembly well accommodates an upper portion of a trigger assembly mounted to the receiver. The magazine well accommodates a magazine. The firearm combines components, along with other features described in this disclosure, to provide an integrated configuration for the firearm.

Now referring to the figures, a firearm 100 is shown with components in an unassembled state. Firearm 100 has a receiver 110 which houses a bolt-firing mechanism (not shown). Receiver 110 of firearm 100 has been designed to provide structural support for easy assembly and disassembly of firearm components. The front end of receiver 110 comprises a foregrip mount portion 112. The backend of receiver 110 comprises a buttstock mount portion 114. A middle portion of receiver 110 disposed between the foregrip mount portion 112 and buttstock mount portion 114 receives a grip frame.

Figure 1:
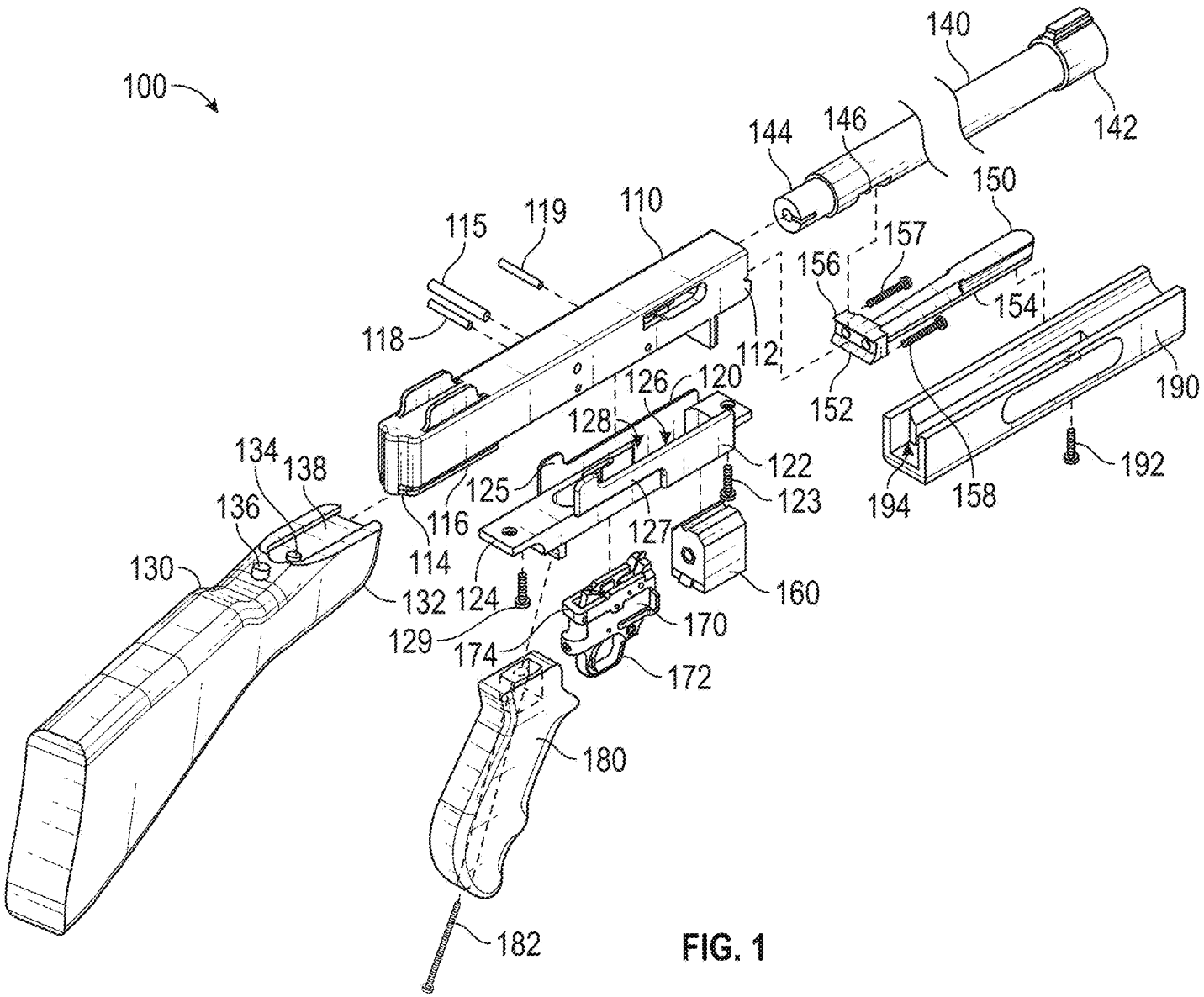
FIG. 1 is an exploded view of the firearm showing the components unassembled.

Buttstock mount portion 114 of the receiver 110 has been designed to attach a buttstock 130, such as a fixed, collapsible, folding, or adjustable stock. Buttstock mount portion 114 comprises a retention rail 116 for attachment of the buttstock 130. As shown in FIG. 1, a first longitudinal groove that is horizontal is disposed on a first side of receiver 110 in the buttstock mount portion 114. A second longitudinal groove, that is horizontal and parallel with the first longitudinal groove, is disposed on a second side of receiver 110 in the buttstock mount portion 114. The two longitudinal grooves extend forward from the backend of receiver 110 along a longitudinal length of buttstock mount portion 114. Retention rail 116 disposed on buttstock mount portion 114 descends downwardly from between the two longitudinal grooves on a bottom side of receiver 110.

Alternatively, a first lateral groove may be vertically disposed on the first side of receiver 110 in the buttstock mount portion 114. A second lateral groove, that is vertical and parallel with the first lateral groove, may be disposed on the second side of receiver 110 in the buttstock mount portion 114. The two lateral grooves may extend upward from the bottom side of receiver 110 along a height of the backend of receiver 110. Retention rail 116 may be disposed between and extend rearwardly from the two lateral grooves on a backside of receiver 110.

Firearm 100 has a buttstock 130 which selectively mounts with receiver 110. The buttstock 130 may be made of various materials such as wood, plastic, and/or metal. Now referring to FIG. 2, buttstock 130 is shown being removably mounted upon receiver 110. Receiver 110 provides a stable support for buttstock 130. The butt end of buttstock 130 is structured to be pressed into the shoulder of a user. The front end 132 of buttstock 130 comprises a receiver mount portion. The receiver mount portion receives the buttstock mount portion 114. Receiver mount portion of buttstock 130 comprises a keyed rail groove 138.

Keyed rail groove 138 may be disposed on the top side of the front end 132 of buttstock 130. Alternatively, keyed rail groove 138 may be disposed on a frontside of the front end 132 of buttstock 130. Keyed rail groove 138 is structured to removably receive the retention rail 116. Retention rail 116 may be structured to slide within keyed rail groove 138. A first longitudinal key that is horizontal is disposed on a first side of buttstock 130 in the receiver mount portion. A second longitudinal key, that is horizontal and parallel with the first longitudinal key, is disposed on a second side of buttstock 130 in the receiver mount portion. Keyed rail groove 138 descends downwardly into the receiver mount portion from between the two longitudinal keys on the top side of buttstock 130.

Figure 2:
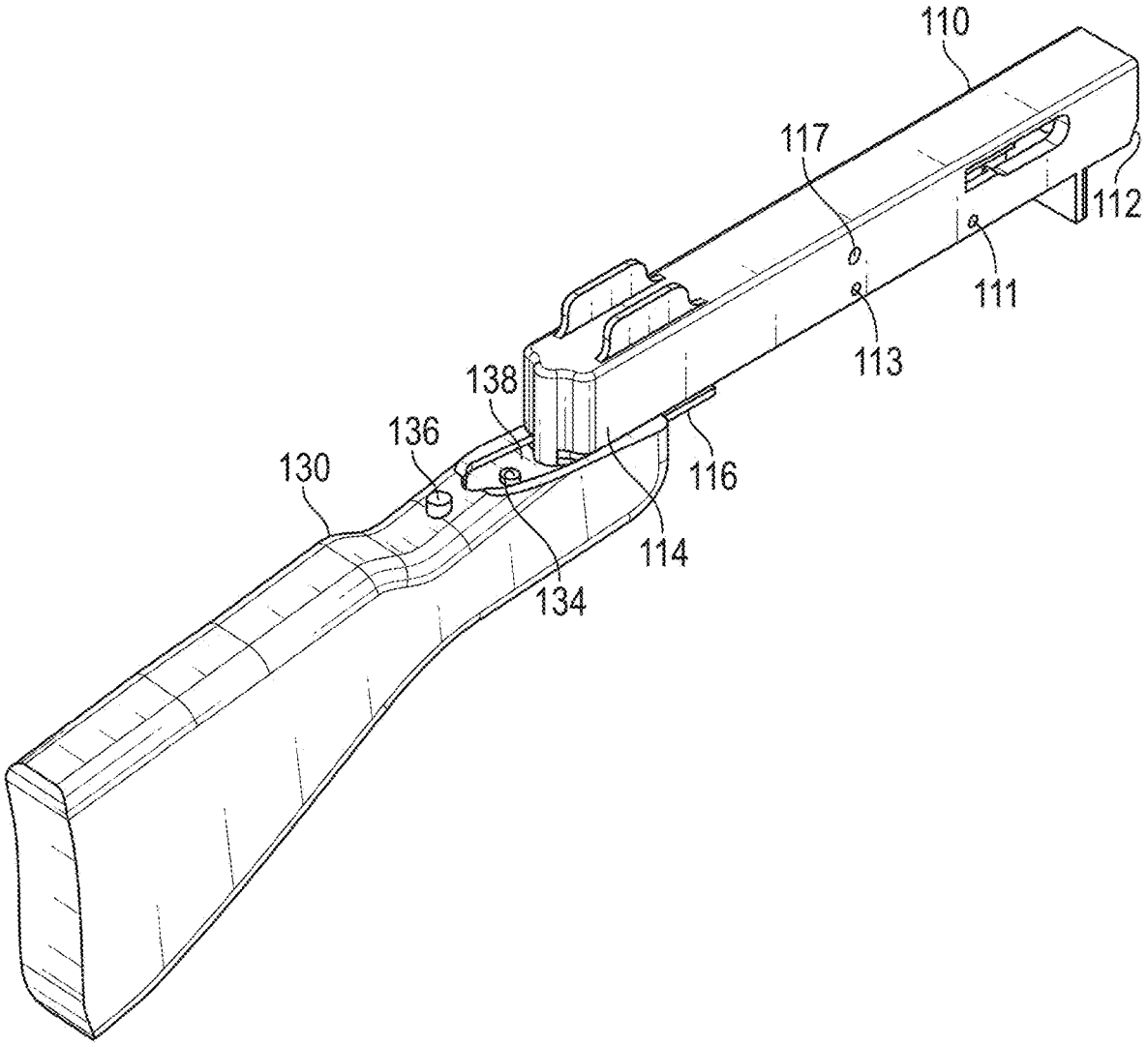
FIG. 2 is a rear perspective view of the buttstock mounted to the receiver.

Still referring to FIG. 2, buttstock 130 may be removably mounted with receiver 110. Buttstock 130 may comprise a retention pin 134. Retention pin 134 may be disposed within keyed rail groove 138 to retain receiver 110 upon buttstock 130. Retention pin 134 may be biased to selectively partially insert into a bottom side of buttstock mount portion 114. A retention pin aperture (not shown) may be disposed in retention rail 116 within buttstock mount portion 114. In an engaged configuration, vertical alignment between retention pin 134 and retention pin aperture locks the buttstock 130 mounted upon receiver 110.

A detent mechanism disposed within receiver mount portion may automatically force retention pin 134 into retention pin aperture upon vertical alignment between the two parts. Detent mechanisms may be a device such as a catch, spring-operated ball, or other latching device. Retention pin 134 holds the longitudinal position of buttstock 130 in relation to receiver 110. The first longitudinal key and second longitudinal key hold vertical and lateral positions of receiver 110 in relation to buttstock 130.

The detent mechanism may be operatively connected to retention pin 134 with a button 136. Button 136 may be mounted on buttstock 130. Button 136 may be disposed on a topside, lateral side, or bottom side of buttstock 130. Button 136 may be structured to disengage retention pin 134 from the retention pin aperture in retention rail 116. Alternatively, a device such as a moveable tab, lever, toggle switch, or other activation device may be utilized operatively with detent mechanism in place of button 136. The activation of button 136 depresses retention pin 134 downwardly from partial insertion into retention pin aperture. In a disengaged configuration, misalignment between retention pin 134 and retention pin aperture unlocks buttstock 130 so that buttstock 130 may be slidably dismounted from receiver 110.

Figure 3:
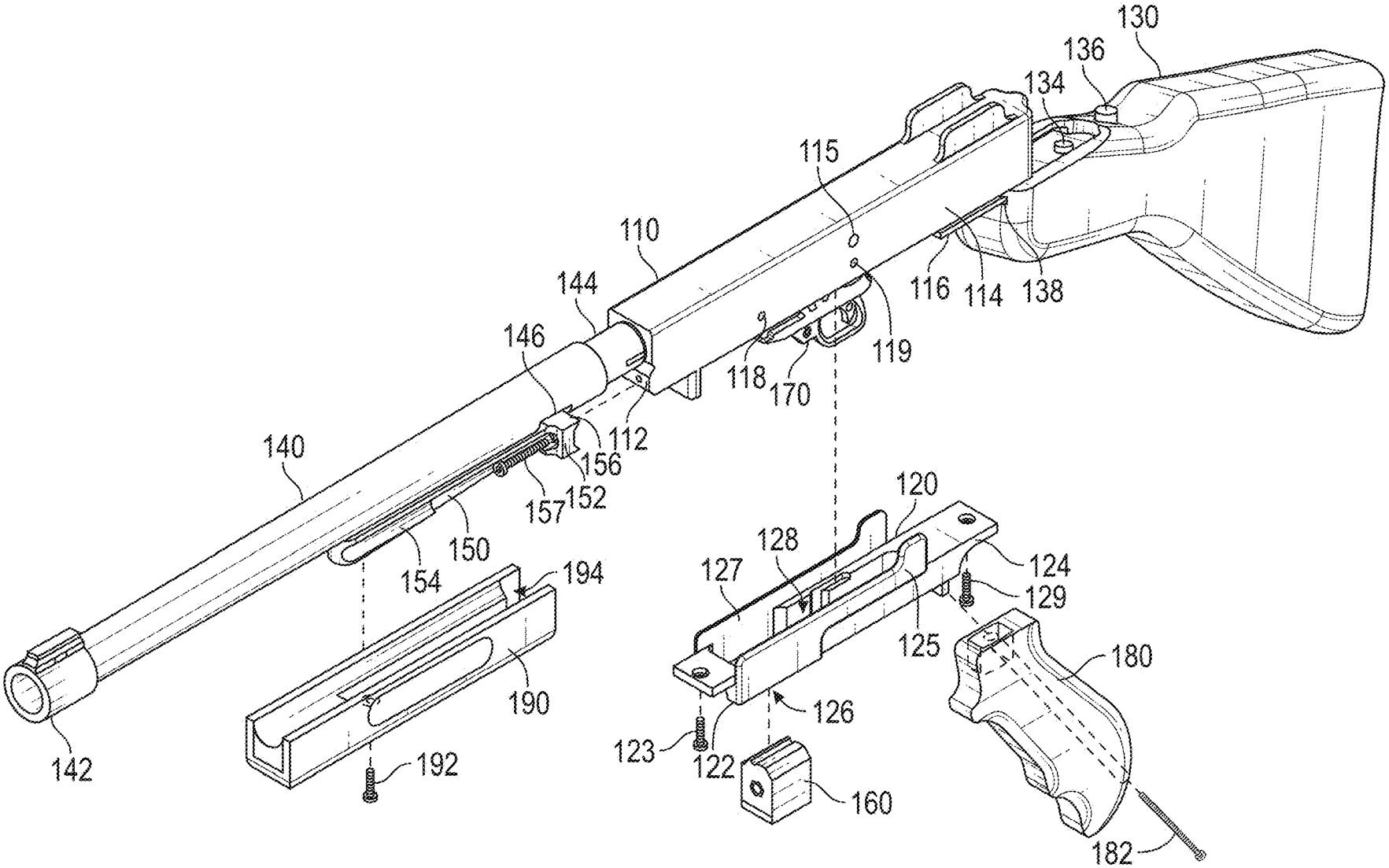
FIG. 3 is a front perspective view of the trigger assembly mounted to the receiver.

Now referring to FIG. 3, a barrel 140 is shown in alignment with receiver 110 for mounting. The barrel 140 has a front end 142 and a rear end 144. A securing mechanism, such as a barrel mount, may be disposed at the rear end 144 of barrel 140. The rear end 144 of barrel 140 may be received by a barrel aperture in the front end of receiver 110. The rear end 144 of barrel 140 may be screw-threaded or keyed to interlock within the barrel aperture. The lower portion of barrel 140 comprises a retaining slot 146 (seen in FIG. 1 and FIG. 3) to facilitate attachment of barrel 140 to receiver 110. The retaining slot 146 may be disposed perpendicular to the length of the barrel 140 horizontally across the lower portion.

Additionally, a barrel-foregrip retainer 150 is shown disposed below the lower portion of barrel 140 in FIG. 3. Barrel-foregrip retainer 150 is utilized to secure the barrel 140 and a foregrip 190 to receiver 110. Barrel-foregrip retainer 150 may be designed to accommodate various types of foregrips, such as horizontal grips, vertical grips, or angled grips to meet shooter preferences for enhancement of control and stability during firing of firearm 100. In the example shown, the foregrip 190 is designed or stocked from a Thompson submachine gun. Channel 194 extends centrally down a longitudinal length of foregrip 190 and is structured to receive barrel-foregrip retainer 150. A foregrip fastener 192 may be utilized to secure the foregrip 190 to the barrel-foregrip retainer 150. Barrel-foregrip retainer 150 may be T-shaped and fit correspondingly within channel 194.

Barrel-foregrip retainer 150 has a block 152 that extends perpendicular to an elongated foregrip mount 154. Elongated foregrip mount 154 extends parallel with barrel 140 when barrel-foregrip retainer 150 is secured to receiver 110. An aperture may be disposed on the bottom side of the elongated foregrip mount 154 to receive the foregrip fastener 192. Block 152 may be secured to the foregrip mount portion 112 of receiver 110 with a pair of fasteners, such as first retainer fastener 157 and a second retainer fastener 158. Foregrip mount portion 112 convexly protrudes out from the front end of receiver 110. Foregrip mount portion 112 may be shaped like a trapezoid. Block 152 has a concavity that accommodates a shape of the foregrip mount portion 112. Alternatively, foregrip mount portion 112 may have a concavity while block 152 has a cooperatively shaped protrusion for mating engagement between the two parts. An upper portion 156 of block 152 is structured to engage the retaining slot 146 in barrel 140 and secures barrel 140 with block 152 mounted to foregrip mount portion 112 of receiver 110. By such engagement, block 152 simultaneously secures barrel 140 and foregrip 190 with barrel-foregrip retainer 150 secured to receiver 110.

Still referring to FIG. 3, a grip frame 120 is shown unassembled from receiver 110. The grip frame 120 is structured to mount with receiver 110. A first grip frame fastener 123 may mount a forward portion 122 of grip frame 120 to a front-bottom side of receiver 110 near the foregrip mount portion 112. A second grip frame fastener 129 may mount a rearward portion 124 of grip frame 120 to a rear-bottom side of receiver 110 near the buttstock mount portion 114.

A handle fastener 182 may mount a handle 180 to the rearward portion 124 of grip frame 120. The handle 180 may be a pistol type grip structured to be grasped by the shooter's hand. A handle mount may descend downward from the rearward portion 124 of grip frame 120 to retain handle fastener 182 when handle 180 is mounted upon handle mount of grip frame 120. A mounting slot may be disposed within a top end of handle 180 and structured to receive the handle mount. The shape of the mounting slot may correspond with an exterior shape of the handle mount.

A magazine well is disposed in the forward portion 122 of grip frame 120. Magazine well 126 of grip frame 120 is structured to removably receive a magazine 160. Magazine 160 may be a 10-round, 20-round, 30-round, or higher round box, drum, stick, or other magazine type with varied caliber size or capacity. In the example shown, a 10-round box magazine designed or stocked from a Ruger 10/22 autoloading rifle is utilized. A vertically descending wall that runs across the width of receiver 110 may fit within a front portion of magazine well 126. The vertical descending wall may have a protrusion that retains magazine 160 when loaded into magazine well 126. Vertical descending wall may also have an arched opening on a bottom side to accommodate a shooter's finger to release magazine 160 from magazine well 126.

A trigger assembly well 128 is disposed in the rearward portion 124 of grip frame 120. Trigger assembly well 128 is shaped and sized to receive and accommodate a trigger assembly 170. As shown in FIG. 3, an upper portion 174 of trigger assembly 170 is mounted to receiver 110 with a first receiver cross pin 118 and a second receiver cross pin 119. First receiver cross pin 118 and a second receiver cross pin 119 are received by first receiver cross pin aperture 111 and second receiver cross pin aperture 113, respectively. The first receiver cross pin 118 and second receiver cross pin 119 secure the trigger assembly 170 to the middle portion of receiver 110. Trigger assembly well 128 is structured to house the upper portion 174 of trigger assembly 170 with a lower portion 172 of the trigger assembly 170 descending downward below the trigger assembly well 128. The trigger assembly 170 is received within the trigger assembly well 128 with grip frame 120 mounted upon receiver 110.

Trigger assembly 170 is the firearm component responsible for initiating the firing sequence. Securely mounting the trigger assembly 170 to the receiver 110 and housing the trigger assembly 170 within the trigger assembly well 128 of grip frame 120 ensures proper operation and safety of receiver 110. Alignment between receiver 110 and grip frame 120 provides integration of trigger assembly 170 in a configuration having enhanced placement and functionality within the structure of firearm 100.

Trigger assembly 170 may be a durable and reliable trigger pack that may be a kit structured to engage bolt-firing mechanisms of different caliber types. Trigger assembly 170 may be a trigger pack kit designed to semi-automatically fire caliber sizes ranging from 22 long rifle, .223 Remington, 5.56×45 NATO, .32 ACP, .38 ACP, 9 mm caliber, .45 ACP, or other caliber size. In the example shown, a trigger pack kit designed or stocked from a Ruger 10/22 autoloading rifle is being utilized as the trigger assembly 170 to enhance performance and accuracy of firearm 100. Integration of trigger assembly 170 into firearm 100 design and configuration achieves a seamless and efficient connection between trigger assembly 170, receiver 110, and grip frame 120.

Alignment of trigger assembly 170 within the structure of the firearm 100 ensures the persistence of reliable firing operations.

The grip frame 120 comprises a cross pin retaining member 127 that may be an elongated vertical sidewall or flange. Cross pin retaining member 127 extends upwardly from grip frame 120 as shown in FIG. 3. Cross pin retaining member 127 is structured to adjacently overlap a first side of receiver 110 upon grip frame 120 being mounted upon receiver 110. Cross pin retaining member 127 retains the first receiver cross pin 118 and second receiver cross pin 119 disposed within receiver 110. A second cross pin retaining member may extend upwardly from the grip frame 120 in a mirror image of cross pin retaining member 127 to adjacently overlap a second side of receiver 110.

The rearward portion 124 of grip frame 120 comprises a bolt stop retaining member 125 which may be a vertical extension of cross pin retaining member 127. Bolt stop retaining member 125 extends upwardly from cross pin retaining member 127 as shown in FIG. 3. A bolt stop pin 115 is shown disposed through a bolt stop pin aperture 117 in the receiver 110 to retain the bolt-firing mechanism (not shown) within receiver 110. Bolt stop retaining member 125 is structured to adjacently overlap and retain the bolt stop pin 115 within the bolt stop pin aperture 117 of receiver 110 as shown in FIG. 4.

Figure 4:
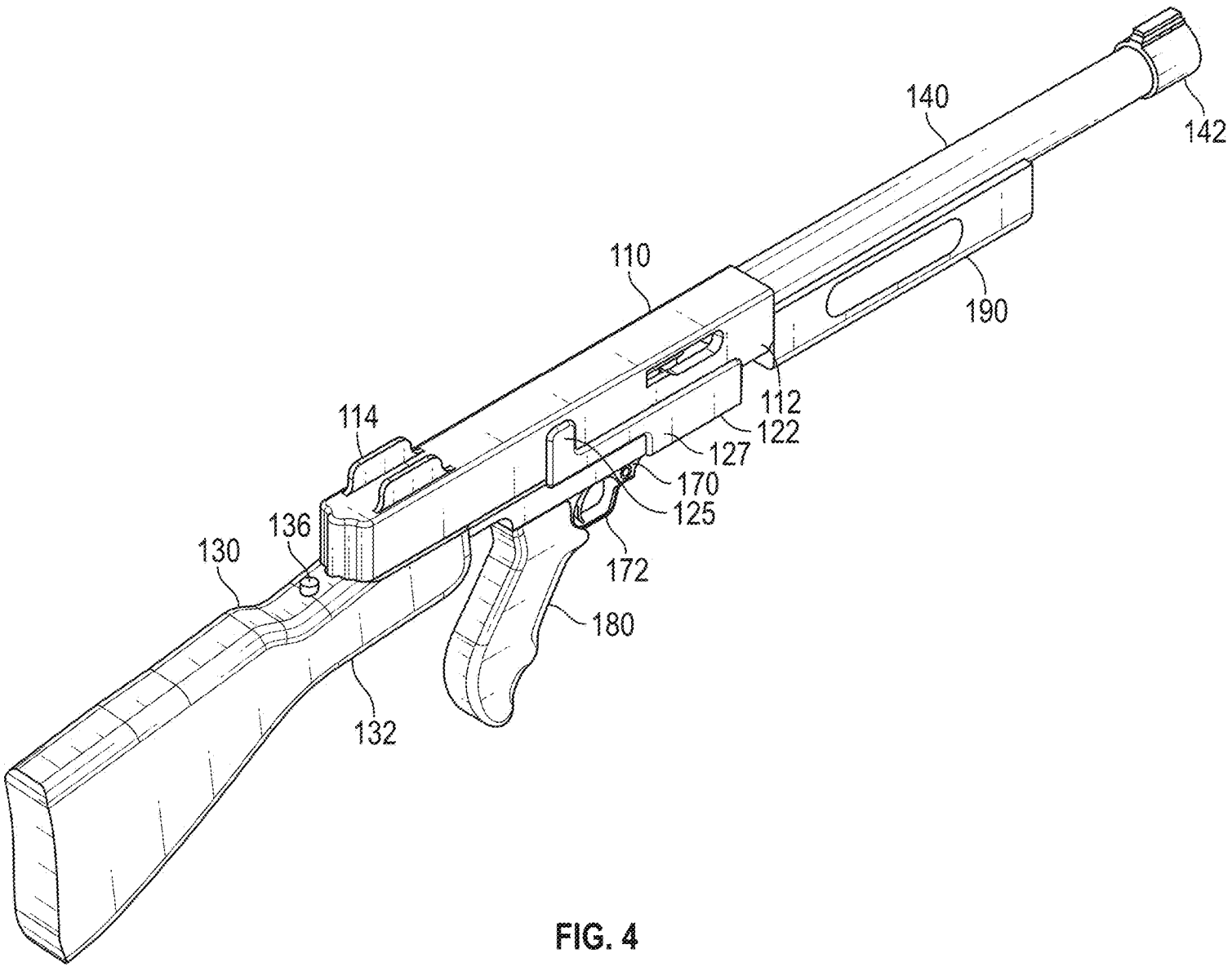
FIG. 4 is a rear perspective view of the assembled firearm.

Firearm 100 shown in FIG. 4 may resemble a fully assembled M1 Thompson that semi-automatically shoots .22 long rifle ammo from a 10-round box rotary magazine or larger round magazine. Firearm 100 may be structured to operatively shoot other calibers and be designed to be compatible with other magazine types. The configuration of receiver 110 aims to provide a secure attachment for the buttstock 130 and barrel 140. Firearm 100 comprises other distinct elements, such as the barrel-foregrip retainer 150 and grip frame 120, which may enhance retention and functionality of firearm 100. Firearm 100 provides a comprehensive solution that seamlessly integrates the receiver 110, grip frame 120, buttstock 130, barrel 140, barrel-foregrip retainer 150, and trigger assembly 170 to enhance firearm performance, simplify assembly and disassembly, and enhance stability of assembled firearm components.

It is understood that the invention is not confined to the particular construction and arrangement of parts herein described. That although the drawings and specification set forth a preferred embodiment, and although specific terms are employed, they are used in a description sense only and embody all such forms as come within the scope of the following claims.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims.

For the convenience of the reader, the above description has focused on a representative sample of all possible embodiments, a sample that teaches the principles of the invention and conveys the best mode contemplated for carrying it out. Throughout this application and its associated file history, when the term "invention" is used, it refers to the entire collection of ideas and principles described; in contrast, the formal definition of the exclusive protected property right is set forth in the claims, which exclusively control. The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed variations, modifications and variations are within the literal scope of the following claims, and others are equivalent.

I claim:

1. A firearm comprising:
- a receiver;
- a trigger assembly comprising:
  - an upper portion mounted to the receiver;
- a grip frame mounted to the receiver, the grip frame comprising:
  - a rearward portion; and
  - a trigger assembly well that is disposed in the rearward portion and houses the upper portion of the trigger assembly; and
  - a barrel partially received into the receiver;
  - a barrel-foregrip retainer mounted to the receiver and secures the barrel to the receiver, the barrel-foregrip retainer comprising:
    - an elongated foregrip mount that extends parallel with the barrel; and
  - a foregrip secured to the elongated foregrip mount to secure the foregrip to the receiver alongside the barrel.

2. The firearm of claim 1, the grip frame further comprising:
- a forward portion; and
- a magazine well that is disposed in the forward portion and removably receives a magazine.

3. The firearm of claim 2, the receiver comprising:
- a vertically descending wall that fits within the magazine well and retains the magazine.

4. The firearm of claim 1, further comprising:
- a first receiver cross pin disposed through the receiver and secures the upper portion of the trigger assembly to the receiver; and
- a cross pin retaining member that extends upwardly from the grip frame and retains the first receiver cross pin disposed within the receiver.

5. A firearm comprising:
- a receiver;
- a trigger assembly comprising:
  - an upper portion mounted to the receiver;
- a first receiver cross pin disposed through the receiver and secures the upper portion of the trigger assembly to the receiver;
- a grip frame mounted to the receiver;
- a cross pin retaining member that extends upwardly from the grip frame and retains the first receiver cross pin disposed within the receiver; and
  - a barrel partially received into the receiver;
  - a barrel-foregrip retainer mounted to the receiver and secures the barrel to the receiver, the barrel-foregrip retainer comprising:
    - an elongated foregrip mount that extends parallel with the barrel; and a foregrip secured to the elongated foregrip mount to secure the foregrip to the receiver alongside the barrel.

6. The firearm of claim 5, wherein the cross pin retaining member adjacently overlaps a side of the receiver.

7. The firearm of claim 5, further comprising:

a second receiver cross pin disposed through the receiver and secures the upper portion of the trigger assembly with the receiver; and wherein the cross pin retaining member is elongated and retains the second receiver cross pin disposed within the receiver.

8. The firearm of claim 5, further comprising:

a bolt stop pin disposed through the receiver; and a bolt stop retaining member that extends upwardly from the cross pin retaining member and retains the bolt stop pin disposed within the receiver.

9. The firearm of claim 5, the grip frame comprising:

a rearward portion; and a trigger assembly well disposed in the rearward portion and houses the upper portion of the trigger assembly.

10. A firearm comprising:

a receiver;

a barrel partially received into the receiver;

a barrel-foregrip retainer mounted to the receiver and secures the barrel to the receiver, the barrel-foregrip retainer comprising:

an elongated foregrip mount that extends parallel with the barrel; and a foregrip secured to the elongated foregrip mount to secure the foregrip to the receiver alongside the barrel.

11. The firearm of claim 10, wherein the barrel-foregrip retainer is T-shaped and fits correspondingly within a channel of the foregrip.

12. The firearm of claim 10, the firearm further comprising:

a retaining slot disposed within the barrel;

a block of the barrel-foregrip retainer, the block comprising:

an upper portion that engages the retaining slot; and wherein the elongated foregrip mount extends perpendicular to the block and parallel with the barrel secured to the receiver by the block.

13. The firearm of claim 10, further comprising:

a trigger assembly comprising:

an upper portion mounted to the receiver;

a grip frame mounted to the receiver, the grip frame comprising:

a rearward portion; and a trigger assembly well that is disposed in the rearward portion and houses the upper portion of the trigger assembly.

14. The firearm of claim 13, further comprising:

a first receiver cross pin disposed through the receiver and secures the upper portion of the trigger assembly to the receiver; and a cross pin retaining member that extends upwardly from the grip frame and retains the first receiver cross pin disposed within the receiver.

* * * * *